US010975463B2

(12) United States Patent
Renteria et al.

(10) Patent No.: US 10,975,463 B2
(45) Date of Patent: Apr. 13, 2021

(54) MONITORING AND CONTROL OF A COATING PROCESS ON THE BASIS OF A HEAT DISTRIBUTION ON THE WORKPIECE

(71) Applicant: Siemens Aktiengesellschaft, München (DE)

(72) Inventors: Arturo Flores Renteria, Berlin (DE); Sascha Martin Kyeck, Berlin (DE); Catrina Michel, Berlin (DE); Alexandr Sadovoy, Berlin (DE); Tolga Yagci, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 483 days.

(21) Appl. No.: 15/513,349

(22) PCT Filed: Sep. 30, 2015

(86) PCT No.: PCT/EP2015/072543

§ 371 (c)(1),
(2) Date: Jul. 12, 2017

(87) PCT Pub. No.: WO2016/055325

PCT Pub. Date: Apr. 14, 2016

(65) Prior Publication Data

US 2017/0321317 A1 Nov. 9, 2017

(30) Foreign Application Priority Data

Oct. 6, 2014 (DE) ..... 102014220180.2

(51) Int. Cl.
*C23C 4/134* (2016.01)
*C23C 4/129* (2016.01)

(52) U.S. Cl.
CPC ..... *C23C 4/134* (2016.01); *C23C 4/129* (2016.01)

(58) Field of Classification Search
CPC ..... C23C 4/134
See application file for complete search history.

(56) References Cited

U.S. PATENT DOCUMENTS 4,656,331 A * 4/1987 Lillquist ..... B23K 9/0956 219/121.47
5,047,612 A 9/1991 Savkar
(Continued)

FOREIGN PATENT DOCUMENTS

DE 19837400 C1 11/1999
DE 19857737 A1 5/2000
(Continued)

OTHER PUBLICATIONS

International Search Report for PCT Application No. PCT/EP2015/072543, dated Nov. 27, 2015.

*Primary Examiner* — Nathan T Leong
(74) *Attorney, Agent, or Firm* — Schmeiser, Olsen & Watts LLP

(57) ABSTRACT

A method for coating a workpiece by using a spraying device is provided. The coating of the workpiece is performed according to at least one coating parameter and at least the following steps are performed during the coating: sensing a locational heat distribution in a working area of a surface of the workpiece; and adjusting the at least one coating parameter in accordance with the sensed heat distribution. A device for coating a workpiece is also provided.

11 Claims, 3 Drawing Sheets

(56) References Cited

U.S. PATENT DOCUMENTS 5,731,030 A * 3/1998 Friese ..... B05B 12/12
427/446
6,024,792 A 2/2000 Kurz et al.

FOREIGN PATENT DOCUMENTS

| | | | |
|---|---|---|---|
| DE | 69715795 | T2 | 5/2003 |
| DE | 10244037 | A1 | 4/2004 |
| DE | 102004010782 | A1 | 9/2005 |
| DE | 102004059549 | A1 | 6/2006 |
| DE | 60307531 | T2 | 4/2007 |
| DE | 102008048262 | A1 | 4/2010 |
| DE | 102009048706 | A1 | 4/2011 |
| DE | 102012021265 | A1 | 4/2014 |
| EP | 0 486 489 | B1 | 11/1994 |
| EP | 0 412 397 | B1 | 3/1998 |
| EP | 0892090 | A1 | 1/1999 |
| EP | 0 786 017 | B1 | 3/1999 |
| EP | 1115894 | A1 | 7/2001 |
| EP | 1 204 776 | A1 | 5/2002 |
| EP | 1 306 454 | A1 | 5/2003 |
| EP | 1 319 729 | A1 | 6/2003 |
| EP | 2876183 | A1 | 5/2015 |
| WO | 9967435 | A1 | 12/1999 |
| WO | 0044949 | A1 | 8/2000 |
| WO | 02 0368 45 | A1 | 5/2002 |
| WO | WO 2005085489 | A1 | 9/2005 |

* cited by examiner

MONITORING AND CONTROL OF A COATING PROCESS ON THE BASIS OF A HEAT DISTRIBUTION ON THE WORKPIECE

CROSS-REFERENCE TO RELATED APPLICATIONS

This application claims priority to PCT Application No. PCT/EP2015/072543, having a filing date of Sep. 30, 2015, based off of German application No. DE 102014220180.2 having a filing date of Oct. 6, 2014, the entire contents of which both are hereby incorporated by reference.

FIELD OF TECHNOLOGY

The following relates to a method for coating a workpiece using a spraying device and a device for carrying out the method according to embodiments of the invention. The workpiece to be coated can in particular be a turbine blade or any other component located in a hot gas path of a gas turbine.

BACKGROUND

Thermally and mechanically highly loaded components such as, for example, turbine components, and in particular in this case turbine blades, are generally coated with a coating material in order to increase the temperature resistance and/or the abrasion resistance of the workpiece. Typical coatings which are used for coating turbine blades are so-called MCrAlX coatings, where M is a metal, for example iron (Fe), cobalt (Co) or nickel (Ni), Cr is chromium, Al is aluminum and X represents yttrium (Y) and/or silicon (Si), scandium (Sc) and/or at least one rare earth element, or hafnium. Ceramic thermal barrier coatings (TBCs), such as zirconium oxide, whose structure is at least partially stabilized by yttrium oxide, are also used, in particular in turbine blades. The coatings described are applied by means of a spraying method to the components to be coated. Examples of such spraying methods are high-speed flame spraying and plasma spraying.

For example, stochastic process deviations can occur during coating of turbine components, in particular turbine blades, with adhesion-promoting, thermal barrier and/or oxidation- and corrosion-inhibiting coatings using spraying methods. These include, among other things, changes in the shape and size of the spray spot due to wear of the electrode in the spraying device, fluctuations in the powder feed, plant failures, etc. Ultimately, significant changes result in abnormal termination of the process or to substandard performance; that is to say that the coated component fails to meet the imposed requirements and must be stripped and subsequently re-coated, or it must be considered a reject.

SUMMARY

An aspect relates to providing an advantageous method and an advantageous device for coating a workpiece using a spraying device, which allow a rapid reaction to deviations of the produced coating, from the desired coating properties.

Embodiments of the invention therefore provides an improved method for coating a workpiece using a spraying device. In that context, the coating of the workpiece is performed according to at least one coating parameter, and at least the following steps are carried out during coating:

detecting a local heat distribution in a working area of a surface of the workpiece; and adjusting the at least one coating parameter as a function of the detected heat distribution.

Embodiments of the invention are based on and incorporates the insight that the course of the coating process can be monitored and controlled by detecting the heat input onto or into the workpiece due to the spray jet of the spraying device in order to ensure that the desired coating properties of the finished coating are achieved. In conventional coating processes such as high-speed flame spraying or plasma spraying, the spray jet, or the coating material transported therein, is strongly heated during the spraying process, so that, using a thermal image, the local distribution and the mass or density of the coating material adhering to the surface of the workpiece can be assessed and it is possible to compare different coating operations on workpieces of the same type. In exceptional cases, the workpiece may be hotter than the sprayed-on coating material. The process according to embodiments of the invention can advantageously be also used here, wherein a corresponding local cooling results instead of a heat input. Nevertheless, the following text discusses a heat input and a heat distribution, although the above-mentioned exceptional cases are not to be excluded.

In general, when carrying out the method according to embodiments of the invention, it is advantageous to bring the temperature of the workpiece to a certain value in order to provide reproducible conditions for different coating processes of samples of the same type of workpiece. Particularly preferably, the workpiece to be coated can be kept at the selected temperature by determining the temperature and heating or cooling the workpiece accordingly.

During the coating process, the spray jet of the spraying device and thus the working area is usually guided along a predetermined path over the surface of the workpiece (of course, the workpiece can in principle also be guided along the spraying device). In this case, the working area denotes the area of the surface of the workpiece in which the coating material is actually being sprayed. In a fully automated process, this path remains the same for each workpiece of the same type, so the heat input into the workpiece by the spray jet should also be the same when the predetermined coating parameters are maintained. If a deviation of the detected heat distribution from the expected heat distribution is determined, the at least one coating parameter can be adapted in order to carry out the coating process as closely as possible following the specifications.

In particular, the detected heat distribution can be compared with stored reference heat distributions. Then, a reference heat distribution which most closely resembles the detected heat distribution is selected from the stored reference heat distributions. Finally, the at least one coating parameter is adapted as a function of a coating parameter data set which is assigned to the selected reference heat distribution. In such embodiments of the invention, a deviation of the actual coating parameter(s) from the predetermined values is determined by considering a deviation of the detected heat distribution from an expectation. In that context, it is assumed that the actual coating parameters deviate from the specification in the same manner as is the case for the coating parameter data sets assigned to the respective reference heat distributions. Therefore, if the detected heat distribution deviates from the reference heat distribution assigned to the actual coating parameters, and is thus similar to a reference heat distribution at an increased feed rate of the coating material, it can be concluded from the coating parameter data set assigned to this reference heat distribution that the coating parameter is currently supplied faster than desired and predetermined. The target for the feed rate can then be lowered accordingly.

Preferably, a difference between the coating parameter data set of the reference heat distribution that most closely resembles the detected heat distribution and the current at least one coating parameter used for the coating is determined. The current at least one coating parameter can then be adapted as a function of this difference. For example, the degree of adaptation of the at least one coating parameter can be proportional to the difference. As a result, even larger deviations from the specification can be quickly compensated for.

The reference heat distributions and the coating parameter data sets respectively assigned to the reference heat distributions are preferably obtained by performing coating operations using the associated coating parameter data sets. For this purpose, samples of the workpiece type to be coated or, in a more cost-effective embodiment, material samples, for example tile-like material samples, can be coated with different coating parameters and the properties of the coatings thus obtained can be assessed.

The stored reference heat distributions can be divided into a plurality of groups, each of the groups being assigned to a respective surface region of the workpiece. When the detected heat distribution is compared with the stored reference heat distributions, the detected heat distribution can be compared with that group of stored reference heat distributions which is assigned to the respective surface region of the workpiece containing the working area for which the detected heat distribution has been detected. Special features such as, for example, the local geometry or other properties of the workpiece, which require variable coating properties and therefore require special coating parameters, can thus be taken into account during the coating of the workpiece.

Preferably, an assessment is assigned to each stored reference heat distribution which contains a statement about at least one coating property, in particular about a coating porosity, a coating roughness or a coating thickness. On the basis of the assigned evaluations, the deviations of the coating process from the specification, which are identified on the basis of the detected heat distribution, can be judged on the basis of their expected effects on the resulting coating properties. This allows a prediction of the quality of the coated workpiece to be taken and can be taken into account during the control of the coating process, for example during the adaptation of the at least one coating parameter.

The heat distribution in the working area of the surface of the workpiece can be detected with a pyrometer or an infrared camera. Alternatively, in the case of sufficiently thin workpieces, it is also possible to detect the heat distribution by means of temperature measuring elements arranged on the rear side of the workpiece.

A plasma spraying method is particularly preferably used in the context of the method according to embodimetns of the invention. In such a case, the at least one coating parameter may comprise at least one coating parameter selected from the group of plasma voltage, powder feed rate of the coating material, or composition of a plasma gas.

A second aspect of embodiments of the invention relates to a device for coating a workpiece. The device is provided with a spraying device, a heat measuring device and a control unit connected to the spraying device and the heat measuring device. The control unit is designed to carry out the method according to embodiments of the invention.

BRIEF DESCRIPTION

Some of the embodiments will be described in detail, with reference to the following figures, wherein like designations denote like members, wherein.

DETAILED DESCRIPTION

Figure 1:
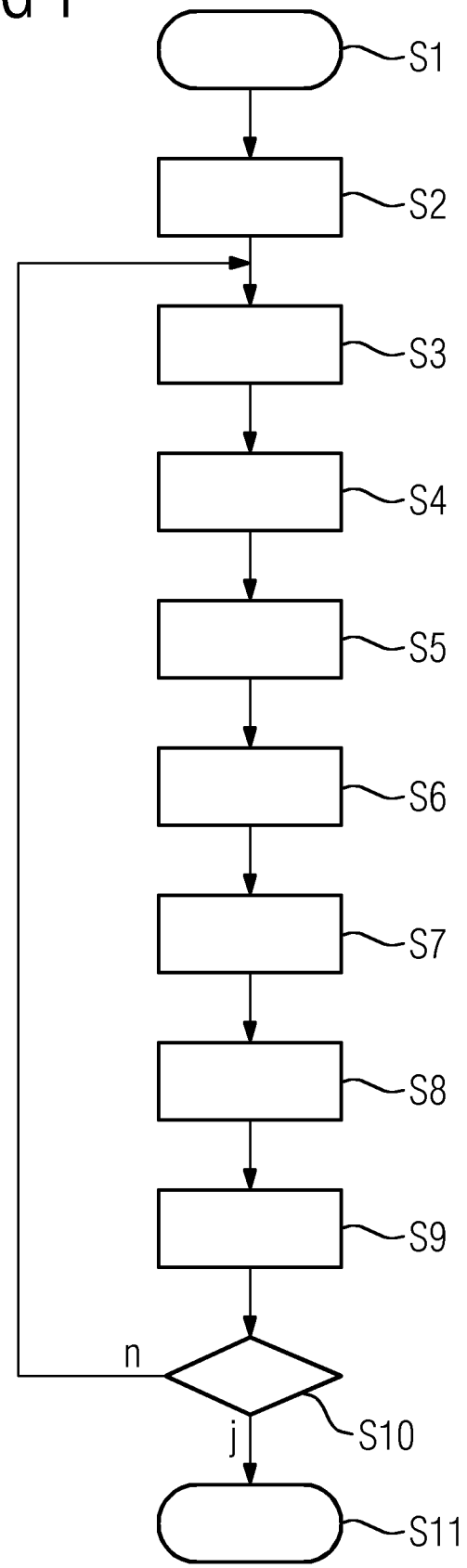
FIG. 1 is a flow chart of an exemplary embodiment of a method.

FIG. 1 shows an exemplary embodiment of the method according to embodiments of the invention in the form of a flow diagram. The method begins with a starting step S1. In the subsequent step S2, a workpiece to be coated is provided and a path is determined along which the spraying device is guided over the surface of the workpiece. In addition, the relevant coating parameter(s) are selected and preset according to the coating to be applied and its desired properties. When using a plasma-based coating process, these coating parameters can in particular comprise a feed rate of the coating material, a plasma voltage or a composition of the plasma gas.

In step S3, the coating process is started or carried out according to the predetermined coating parameter(s). The coating process can be carried out continuously or can be interrupted periodically in order to carry out the further process steps S4 to S10. However, because of the shorter process time, continuous coating is preferred.

In step S4, a heat distribution of the working area on the surface of the workpiece is detected. This is preferably carried out with an imaging method which determines a respective temperature for the individual locations of the surface of the workpiece. The higher the resolution of the imaging process, the more precisely the heat distribution can be assessed.

In step S5, the detected heat distribution is compared with a plurality of reference heat distributions. For the comparison, a group of reference heat distributions, regarded as representative of the currently coated partial surface of the workpiece, can be selected from the total quantity of reference heat distributions. In the present exemplary embodiment, the comparison identifies the reference heat distribution which most closely resembles the detected heat distribution. Thereupon, in step S6, the coating parameter data set associated with the identified reference heat distribution is compared with the currently predetermined coating parameter(s). The coating parameter data set reproduces those coating parameters which have produced the assigned reference heat distribution during a sample execution of the coating process. Since the resulting heat distribution in each case depends on the actual coating parameters, the actual values of the coating parameters of the actual coating process are inferred by considering the coating parameters associated with the identified reference heat distribution. In step S7, a deviation is determined between the assigned coating parameter data set and the predetermined coating parameter(s). In this case, it is assumed that the spraying device has not observed the predetermined at least one coating parameter if a detected heat distribution differs from the expectation. Subsequently, a correction value or a set of correction values is calculated in step S8, depending on the previously determined deviation, by which the at least one coating parameter is adapted in step S9. Adapting the at least one coating parameter is intended to make the coating process be carried out more precisely according to the specifications.

Finally, step S10 involves verification of whether the end of the path, along which the workpiece is coated, has been reached. If this is not the case, the coating process and the method according to embodiments of the invention are continued by returning to step S3; otherwise, the process is ended in step S11. It is subsequently possible to examine the properties of the coating and, if necessary, adjust the coating parameter data sets associated with the reference heat distributions. It is also conceivable to select one or more of the heat distributions detected during the execution of the method, and to make them available as reference heat distributions for further process runs. To that end, it is possible to store the detected heat distributions and the respective associated coating parameter(s) during a process run. It is in particular also conceivable to assess the significance of the individual (reference) heat distributions and, over a large number of process runs, to achieve improved reproducibility of the coating process.

Figure 2:
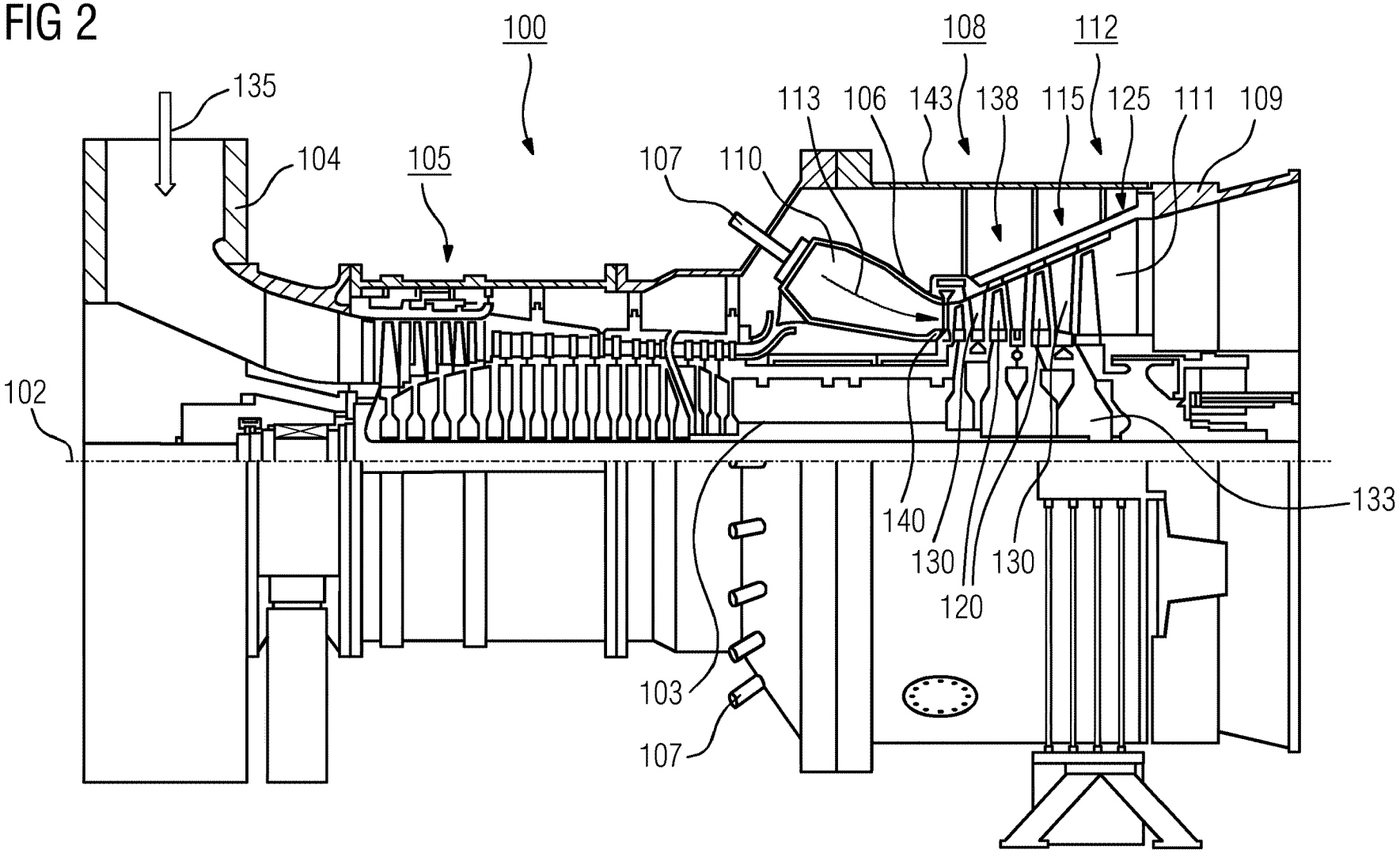
FIG. 2 depicts a gas turbine in partial longitudinal section.

FIG. 2 shows, by way of example, a partial longitudinal section through a gas turbine 100. The method according to embodiments of the invention is particularly suitable for the coating of components of such a gas turbine 100.

Inside, the gas turbine 100 has a rotor 103 with a shaft 101 which is mounted such that it can rotate about an axis of rotation 102 and is also referred to as the turbine rotor.

An intake housing 104, a compressor 105, a, for example, toroidal combustion chamber 110, in particular an annular combustion chamber, with a plurality of coaxially arranged burners 107, a turbine 108 and the exhaust-gas housing 109 follow one another along the rotor 103.

The annular combustion chamber 110 is in communication with a for example annular hot gas duct 111. There, for example four series-connected turbine stages 112 form the turbine 108.

Each turbine stage 112 is formed, for example, from two blade or vane rings. As seen in the direction of flow of a working medium 113, in the hot gas duct 111 a row of guide vanes 115 is followed by a row 125 formed from rotor blades 120.

The guide vanes 130 are secured to an inner housing 138 of a stator 143, whereas the rotor blades 120 of a row 125 are fitted to the rotor 103 for example by means of a turbine disk 133.

A generator or a working machine (not shown) is coupled to the rotor 103.

While the gas turbine 100 is operating, the compressor 105 sucks in air 135 through the intake housing 104 and compresses it. The compressed air provided at the turbine-side end of the compressor 105 is passed to the burners 107, where it is mixed with a fuel. The mix is then burnt in the combustion chamber 110, forming the working medium 113. From there, the working medium 113 flows along the hot gas duct 111 past the guide vanes 130 and the rotor blades 120. The working medium 113 expands at the rotor blades 120, imparting momentum, so that the rotor blades 120 drive the rotor 103 and the latter drives the machine coupled to it.

While the gas turbine 100 is operating, the components which are exposed to the hot working medium 113 are subject to thermal stresses. The guide vanes 130 and rotor blades 120 of the first turbine stage 112, as seen in the direction of flow of the working medium 113, together with the heat shield elements which line the annular combustion chamber 110, are subject to the highest thermal stresses.

To be able to withstand the temperatures which prevail there, they may be cooled by means of a coolant.

Substrates of the components may likewise have a directional structure, i.e. they are in single-crystal form (SX structure) or have only longitudinally oriented grains (DS structure).

By way of example, iron-based, nickel-based or cobalt-based superalloys are used as material for the components, in particular for the turbine blade or vane 120, 130 and components of the combustion chamber 110.

Superalloys of this type are known, for example, from EP 1 204 776 B1, EP 1 306 454, EP 1 319 729 A1, WO 99/67435 or WO 00/44949.

The blades or vanes 120, 130 may likewise have coatings protecting against corrosion (MCrAlX; M is at least one element selected from the group consisting of iron (Fe), cobalt (Co), nickel (Ni), X is an active element and stands for yttrium (Y) and/or silicon, scandium (Sc) and/or at least one rare earth element, or hafnium). Alloys of this type are known from EP 0 486 489 B1, EP 0 786 017 B1, EP 0 412 397 B1 or EP 1 306 454 A1.

It is also possible for a thermal barrier coating to be present on the MCrAlX, consisting for example of ZrO2, Y2O3-ZrO2, i.e. unstabilized, partially stabilized or fully stabilized by yttrium oxide and/or calcium oxide and/or magnesium oxide.

Columnar grains are produced in the thermal barrier coating by suitable coating processes, such as for example electron beam physical vapor deposition (EB-PVD).

The guide vane 130 has a guide vane root (not shown here), which faces the inner housing 138 of the turbine 108, and a guide vane head which is at the opposite end from the guide vane root. The guide vane head faces the rotor 103 and is fixed to a securing ring 140 of the stator 143.

Figure 3:
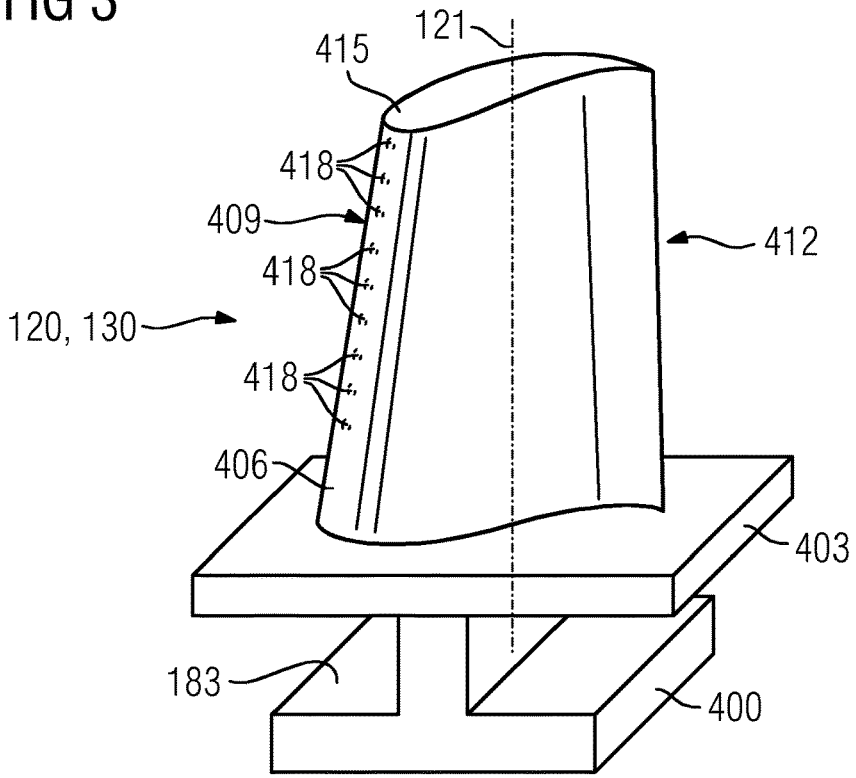
FIG. 3 is a perspective view of an embodiment of a rotor blade or guide vane of a flow machine.

FIG. 3 shows a perspective view of a rotor blade 120 or guide vane 130 of a turbomachine, which extends along a longitudinal axis 121.

The turbomachine may be a gas turbine of an aircraft or of a power plant for generating electricity, a steam turbine or a compressor.

The blade or vane 120, 130 has, in succession along the longitudinal axis 121, a securing region 400, an adjoining blade platform 403 and a blade airfoil 406 and a blade tip 415.

As a guide vane 130, the vane 130 may have a further platform (not shown) at its vane tip 415.

A blade or vane root 183, which is used to secure the rotor blades 120, 130 to a shaft or a disk (not shown), is formed in the securing region 400.

The blade or vane root 183 is designed, for example, in hammerhead form. Other configurations, such as a fir-tree or dovetail root, are possible.

The blade or vane 120, 130 has a leading edge 409 and a trailing edge 412 for a medium which flows past the blade or vane airfoil 406.

In the case of conventional blades or vanes 120, 130, by way of example solid metallic materials, in particular superalloys, are used in all regions 400, 403, 406 of the blade or vane 120, 130.

Superalloys of this type are known, for example, from EP 1 204 776 B1, EP 1 306 454, EP 1 319 729 A1, WO 99/67435 or WO 00/44949.

The blade or vane 120, 130 may in this case be produced by a casting process, by means of directional solidification, by a forging process, by a milling process or combinations thereof.

Workpieces with a single-crystal structure or structures are used as components for machines which, in operation, are exposed to high mechanical, thermal and/or chemical stresses.

Single-crystal workpieces of this type are produced, for example, by directional solidification from the melt. This involves casting processes in which the liquid metallic alloy solidifies to form the single-crystal structure, i.e. the single-crystal workpiece, or solidifies directionally.

In this case, dendritic crystals are oriented along the direction of heat flow and form either a columnar crystalline grain structure (i.e. grains which run over the entire length of the workpiece and are referred to here, in accordance with the language customarily used, as directionally solidified) or a single-crystal structure, i.e. the entire workpiece consists of one single crystal. In these processes, a transition to globular (polycrystalline) solidification needs to be avoided, since non-directional growth inevitably forms transverse and longitudinal grain boundaries, which negate the favorable properties of the directionally solidified or single-crystal component.

Where the text refers in general terms to directionally solidified microstructures, this is to be understood as meaning both single crystals, which do not have any grain boundaries or at most have small-angle grain boundaries, and columnar crystal structures, which do have grain boundaries running in the longitudinal direction but do not have any transverse grain boundaries. This second form of crystalline structures is also described as directionally solidified structures.

Processes of this type are known from U.S. Pat. No. 6,024,792 and EP 0 892 090 A1.

The blades or vanes 120, 130 may likewise have coatings protecting against corrosion or oxidation, e.g. (MCrAlX; M is at least one element selected from the group consisting of iron (Fe), cobalt (Co), nickel (Ni), X is an active element and stands for yttrium (Y) and/or silicon and/or at least one rare earth element, or hafnium (Hf)). Alloys of this type are known from EP 0 486 489 B1, EP 0 786 017 B1, EP 0 412 397 B1 or EP 1 306 454 A1.

The density is preferably 95% of the theoretical density.

A protective aluminum oxide layer (TGO=thermally grown oxide layer) is formed on the MCrAlX layer (as an intermediate layer or as the outermost layer).

The layer preferably has a composition Co-30Ni-28Cr-8Al-0.6Y-0.7Si or Co-28Ni-24Cr-10Al-0.6Y. In addition to these cobalt-based protective coatings, it is also preferable to use nickel-based protective layers, such as Ni-10Cr-12Al-0.6Y-3Re or Ni-12Co-21Cr-11Al-0.4Y-2Re or Ni-25Co-17Cr-10Al-0.4Y-1.5Re.

It is also possible for a thermal barrier coating, which is preferably the outermost layer and consists for example of ZrO2, Y2O3-ZrO2, i.e. it is unstabilized, partially stabilized or fully stabilized by yttrium oxide and/or calcium oxide and/or magnesium oxide, to be present on the MCrAlX. The thermal barrier coating covers the entire MCrAlX layer.

Columnar grains are produced in the thermal barrier coating by suitable coating processes, such as for example electron beam physical vapor deposition (EB-PVD).

Other coating processes are conceivable, for example atmospheric plasma spraying (APS), LPPS, VPS or CVD. The thermal barrier coating may include grains that are porous or have micro-cracks or macro-cracks, in order to improve the resistance to thermal shocks. The thermal barrier coating is therefore preferably more porous than the MCrAlX layer.

Refurbishment means that, after they have been used, protective layers may have to be removed from components 120, 130 (e.g. by sand-blasting). Then, the corrosion and/or oxidation layers and products are removed. If appropriate, cracks in the component 120, 130 are also repaired. This is followed by re-coating of the component 120, 130, after which the component 120, 130 can be reused.

The blade or vane 120, 130 may be hollow or solid. If the blade or vane 120, 130 is to be cooled, it is hollow and may also have film-cooling holes 418 (indicated by dashed lines).

Figure 4:
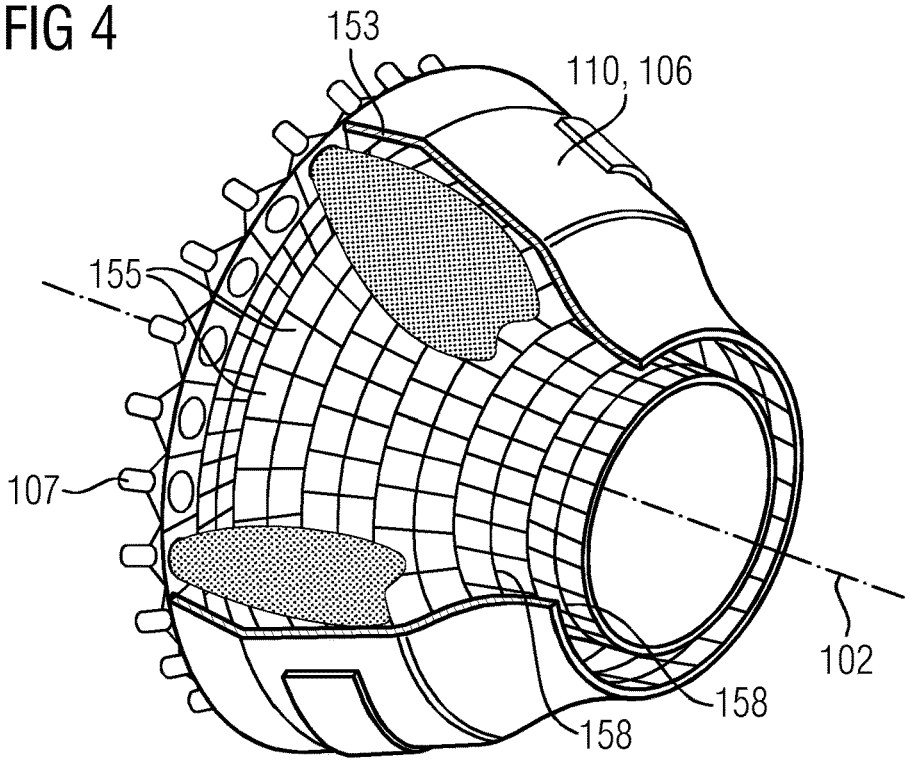
FIG. 4 shows an embodiment of a combustion chamber of a gas turbine.

FIG. 4 shows a combustion chamber 110 of a gas turbine. The combustion chamber 110 is configured, for example, as what is known as an annular combustion chamber, in which a multiplicity of burners 107, which generate flames 156, are arranged circumferentially around an axis of rotation 102 and open out into a common combustion chamber space 154. For this purpose, the combustion chamber 110 overall is of annular configuration positioned around the axis of rotation 102.

To achieve a relatively high efficiency, the combustion chamber 110 is designed for a relatively high temperature of the working medium M of approximately 1000° C. to 1600° C. To allow a relatively long service life even with these operating parameters, which are unfavorable for the materials, the combustion chamber wall 153 is provided, on its side which faces the working medium M, with an inner lining formed from heat shield elements 155.

On the working medium side, each heat shield element 155 made from an alloy is equipped with a particularly heat-resistant protective layer (MCrAlX layer and/or ceramic coating) or is made from material that is able to withstand high temperatures (solid ceramic bricks).

These protective layers may be similar to the turbine blades or vanes, i.e. for example MCrAlX: M is at least one element selected from the group consisting of iron (Fe), cobalt (Co), nickel (Ni), X is an active element and stands for yttrium (Y) and/or silicon and/or at least one rare earth element or hafnium (Hf). Alloys of this type are known from EP 0 486 489 B1, EP 0 786 017 B1, EP 0412397 B1 or EP 1306 454 A1.

It is also possible for a, for example, ceramic thermal barrier coating to be present on the MCrAlX, consisting for example of ZrO2, Y2O3-ZrO2, i.e. unstabilized, partially stabilized or fully stabilized by yttrium oxide and/or calcium oxide and/or magnesium oxide.

Columnar grains are produced in the thermal barrier coating by suitable coating processes, such as for example electron beam physical vapor deposition (EB-PVD).

Other coating methods are conceivable, e.g. atmospheric plasma spraying (APS), LPPS, VPS or CVD. The thermal barrier coating may include grains that are porous or have micro-cracks or macro-cracks, in order to improve the resistance to thermal shocks.

Refurbishment means that, after they have been used, protective layers may have to be removed from heat shield elements 155 (e.g. by sand-blasting). Then, the corrosion and/or oxidation layers and products are removed. If appropriate, cracks in the heat shield element 155 are also repaired. This is followed by re-coating of the heat shield elements 155, after which the heat shield elements 155 can be reused.

Moreover, a cooling system may be provided for the heat shield elements 155 and/or their holding elements, on account of the high temperatures in the interior of the combustion chamber 110. The heat shield elements 155 are then, for example, hollow and may also have cooling holes (not shown) opening out into the combustion chamber space 154.

Although the present invention has been described with reference to an exemplary embodiment, it is to be understood that this exemplary embodiment merely serves for the exemplary illustration of the invention and that deviations from this exemplary embodiment are possible. The invention is therefore not intended to be limited to the embodiment of the exemplary embodiment, but merely by the appended claims.

The claims are as follows:

1. A method for coating a workpiece using a spraying device, comprising:

coating the workpiece according to at least one coating parameter along a path across a surface of the workpiece, wherein during the coating:

a local heat distribution is detected at multiple locations of the workpiece as the spraying device is guided along the path; and the at least one coating parameter is adjusted as a function of the detected local heat distribution;

wherein the detected local heat distribution is compared with stored reference heat distributions, and wherein the at least one coating parameter is adapted as a function of a coating parameter data set which is assigned to a reference heat distribution, of the stored reference heat distributions, that most closely resembles the detected local heat distribution;

wherein the stored reference heat distributions are divided into a plurality of groups, each group of the plurality of groups being assigned to a respective surface region of the workpiece, and wherein, when the detected local heat distribution is compared with the stored reference heat distributions, the detected local heat distribution is compared with the group of stored reference heat distributions which is assigned to the respective surface region of the workpiece containing the working area for which the detected local heat distribution has been detected.

2. The method of claim 1, in which a difference between the coating parameter data set of the reference heat distribution that most closely resembles the detected local heat distribution and a current at least one coating parameter used for the coating is determined, and the current at least one coating parameter is adapted as a function of the difference.

3. The method of claim 1, in which the reference heat distributions and the coating parameter data sets respectively assigned to the reference heat distributions have been obtained by performing coating operations using the associated coating parameter data sets.

4. The method in claim 1, in which an assessment is assigned to each stored reference heat distribution which contains a statement about at least one coating property.

5. The method of claim 4, wherein the at least one coating property includes a coating porosity, a coating roughness, or a coating thickness.

6. The method of claim 1, in which the local heat distribution in the working area of the surface of the workpiece is detected with a pyrometer or an infrared camera.

7. The method of claim 1, in which a plasma spraying method is used.

8. The method of claim 7 wherein the at least one coating parameter comprises at least one of plasma voltage, powder feed rate, or composition of a plasma gas.

9. The method of claim 1, wherein the coating is continuous.

10. The method of claim 1, wherein the coating is periodically interrupted to adjust the at least one coating parameter.

11. The method of claim 1, further comprising:

bringing a temperature of the workpiece to a specific value; and maintaining the temperature at the specific value by at least one of: heating and cooling the workpiece.

* * * * *